US007755338B2

(12) United States Patent
Taha et al.

(10) Patent No.: US 7,755,338 B2
(45) Date of Patent: Jul. 13, 2010

(54) VOLTAGE REGULATOR POLE SHIFTING METHOD AND APPARATUS

(75) Inventors: Iman Taha, Cary, NC (US); Vincent Acierno, Chapel Hill, NC (US)

(73) Assignee: Qimonda North America Corp., Durham, NC (US)

( * ) Notice: Subject to any disclaimer, the term of this patent is extended or adjusted under 35 U.S.C. 154(b) by 434 days.

(21) Appl. No.: 11/776,688

(22) Filed: Jul. 12, 2007

(65) Prior Publication Data

US 2009/0015219 A1 Jan. 15, 2009

(51) Int. Cl.
*G05F 1/575* (2006.01)

(52) U.S. Cl. ..... 323/280

(58) Field of Classification Search ..... 323/273, 323/280

See application file for complete search history.

(56) References Cited

U.S. PATENT DOCUMENTS

| | | | | |
|---|---|---|---|---|
| 5,861,736 | A | 1/1999 | Corsi et al. | |
| 5,909,109 | A * | 6/1999 | Phillips | 323/277 |
| 6,208,206 | B1 | 3/2001 | Leung et al. | |
| 6,333,623 | B1 * | 12/2001 | Heisley et al. | 323/280 |
| 6,369,554 | B1 * | 4/2002 | Aram | 323/282 |
| 6,504,423 | B2 | 1/2003 | Riggio et al. | |
| 7,106,033 | B1 * | 9/2006 | Liu et al. | 323/280 |
| 7,173,401 | B1 * | 2/2007 | Huang | 323/277 |
| 7,205,827 | B2 | 4/2007 | Leung et al. | |
| 7,218,082 | B2 * | 5/2007 | Walter et al. | 323/273 |
| 2005/0189930 | A1 * | 9/2005 | Wu et al. | 323/280 |
| 2006/0132107 | A1 * | 6/2006 | Sicard | 323/280 |
| 2007/0018621 | A1 | 1/2007 | Mok et al. | |
| 2008/0157735 | A1 * | 7/2008 | Liu et al. | 323/280 |

FOREIGN PATENT DOCUMENTS

DE 69605915 T2 5/2000

OTHER PUBLICATIONS

Al-Shyoukh et al., "A Transient-Enhanced 20μA-Quiescent 200mA-Load Low-Dropout Regulator with Buffer Impedance Attenuation," Proceedings of the IEEE 2006 Custom Integrated Circuits Conference (CICC), pp. 615-618.

Allen et al., "CMOS Analog Circuit Design," 2nd ed., 2002, pp. 228-229, Oxford University Press, New York, NY.

Sansen, "Analog Design Essentials," 2006, p. 369, Springer, Dordrecht, The Netherlands.

* cited by examiner

*Primary Examiner*—Jeffrey L Sterrett
(74) *Attorney, Agent, or Firm*—Coats & Bennett, P.L.L.C.

(57) ABSTRACT

A voltage regulator comprises first and second amplifier stages, a common-source output stage and a feedback path. The output stage drives a capacitive load with a regulated voltage responsive to a signal applied to the output stage. The capacitive load sets the dominant pole of the voltage regulator. The first amplifier stage amplifies the difference between the regulated voltage and a reference voltage. The second amplifier stage drives the output stage with a signal corresponding to the difference between the regulated voltage and the reference voltage. The feedback path couples an output node of the second amplifier stage to an input node of the second amplifier stage for reducing the output resistance of the second amplifier stage to shift a non-dominant pole of the voltage regulator set by the second amplifier stage.

19 Claims, 4 Drawing Sheets

VOLTAGE REGULATOR POLE SHIFTING METHOD AND APPARATUS

BACKGROUND OF THE INVENTION

Many kinds of voltage regulators have multiple amplifier stages and an output stage. The input amplifier stage provides an amplified error signal corresponding to the difference between a reference voltage input and a regulated voltage provided by the output stage. The error signal, after one or more subsequent stages of amplification, is applied to the regulator output stage. The amplifier error signal causes the regulator output stage to maintain a regulated voltage level regardless of changing load conditions. One or more amplifier stages included after the input stage provide error signal gain and isolate the regulator output stage from the input amplifier stage. Multiple amplifier stages are typically needed to provide sufficient gain before the error signal is applied to the output stage since the magnitude of the error signal controls current flow in the output stage. Otherwise, poor load regulation results for applications having high load conditions.

Fast load regulation is an important specification for a regulator. A regulator having a source follower driver provides fast load regulation. However, this type of regulator requires high voltage headroom to operate the source follower in saturation. The source follower driver is typically powered by a boosted supply voltage for low-voltage applications, which can be problematic. Replacing the source follower driver with a common-source driver overcomes the voltage headroom limitation. However, regulation speed is limited by the bandwidth of the amplifier feedback loop when a common-source driver is used.

The regulated voltage provided by an output stage of a multi-stage regulator may drive a capacitive load which can be high for many applications. When a high capacitive load is driven, the dominant pole of a regulator with a common source driver is set by the capacitive load. Each amplifier stage included in the regulator sets a non-dominant pole. A non-dominant pole close to the dominant pole affects the bandwidth (frequency range) of the multi-stage amplifier. Correspondingly, this non-dominant pole also affects the transient response time of the multi-stage amplifier. Voltage regulator performance suffers when the amplifier response time is not sufficiently fast, i.e., when the amplifier bandwidth is too low.

Amplifier bandwidth may be increased by decreasing the output resistance of the last amplifier stage which feeds the common-source output stage. Conventionally, this has been achieved by increasing the bias current and/or by increasing the device size of the stage. However, increasing bias current increases power consumption which may create thermal dissipation concerns. Increasing the device size of the last amplifier stage worsens parasitic capacitance, thus reducing amplifier stability.

SUMMARY OF THE INVENTION

According to the methods and apparatus taught herein, a voltage regulator comprises first and second amplifier stages, a common-source output stage and a feedback path. The output stage drives a capacitive load with a regulated voltage responsive to a signal applied to the output stage. The capacitive load sets the dominant pole of the voltage regulator. The first amplifier stage amplifies the difference between the regulated voltage and a reference voltage. The second amplifier stage drives the output stage with a signal corresponding to the difference between the regulated voltage and the reference voltage. The feedback path couples an output node of the second amplifier stage to an input node of the second amplifier stage for reducing the output resistance of the second amplifier stage to shift a non-dominant pole of the voltage regulator set by the second amplifier stage.

Of course, the present invention is not limited to the above features and advantages. Those skilled in the art will recognize additional features and advantages upon reading the following detailed description, and upon viewing the accompanying drawings.

DETAILED DESCRIPTION OF THE INVENTION

Figure 1:
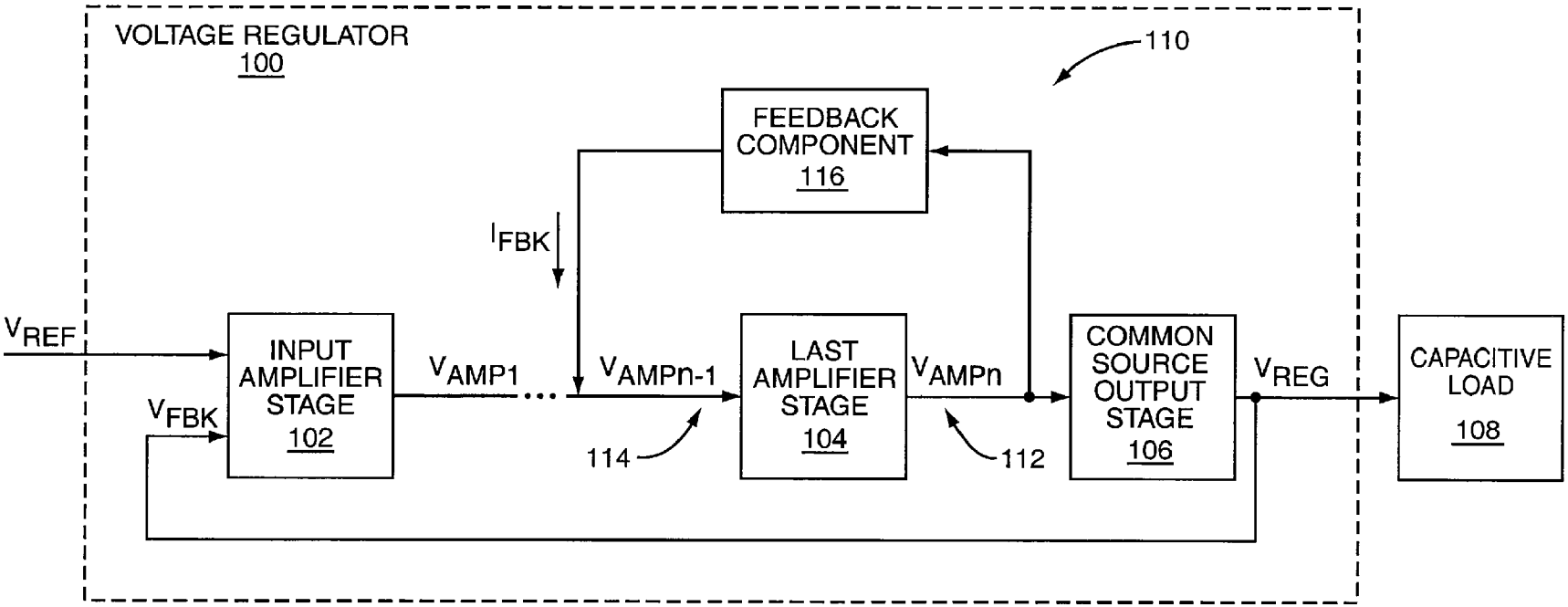
FIG. 1 is a block diagram of an embodiment of a voltage regulator including multiple amplifier stages and a common-source output stage.

FIG. 1 illustrates an embodiment of a voltage regulator 100 including multiple amplifier stages 102, 104 and a common-source output stage 106 such as a pfet output driver. The common-source output stage 106 maintains a regulated voltage level ($V_{REG}$) regardless of changing load conditions in response to an amplified error signal ($V_{AMPn}$) applied to the output stage 106 by the last amplifier stage 104. The regulated voltage level provided by the output stage 106 drives a capacitive load 108. The capacitive load is large enough to set the dominant pole of the regulator. Non-dominant poles are set by the amplifier stages 102, 104. The non-dominant pole set by the last amplifier stage 104 affects the amplifier bandwidth. The regulator 100 further includes a feedback path 110 coupling the output node 112 of the last amplifier stage 104 to its input node 114 for reducing the output resistance of the last amplifier stage 104. The transconductance ($g_m$) of the last amplifier stage 104 increases when its output resistance is reduced. The transient response of the regulator 100 improves when the $g_m$ of the last amplifier stage 106 is increased via the feedback path 110.

In more detail, the regulated voltage output by the regulator 100 is fed back to the input amplifier stage 102 as a feedback signal ($V_{FBK}$). A reference voltage signal ($V_{REF}$) is also applied to the input amplifier stage 102. The input amplifier stage 102 generates an error signal ($V_{AMP1}$) corresponding to the difference between the regulated feedback voltage and the reference voltage. One or more additional amplifier stages (not shown) may be included between the input amplifier stage 102 and the last amplifier stage 104 for providing additional gain. The amplifier stage preceding the last amplifier stage 104 drives the last amplifier stage 104 with an amplified error signal ($V_{AMPn-1}$). The last amplifier stage 104 provides additional gain and applies the resulting amplified error signal ($V_{AMPn}$) to the regulator output stage 106, e.g., as illustrated by Step 200 of FIG. 2. The last amplifier stage 104 also isolates the preceding amplifier stages 102 from the output stage 106.

Figure 2:
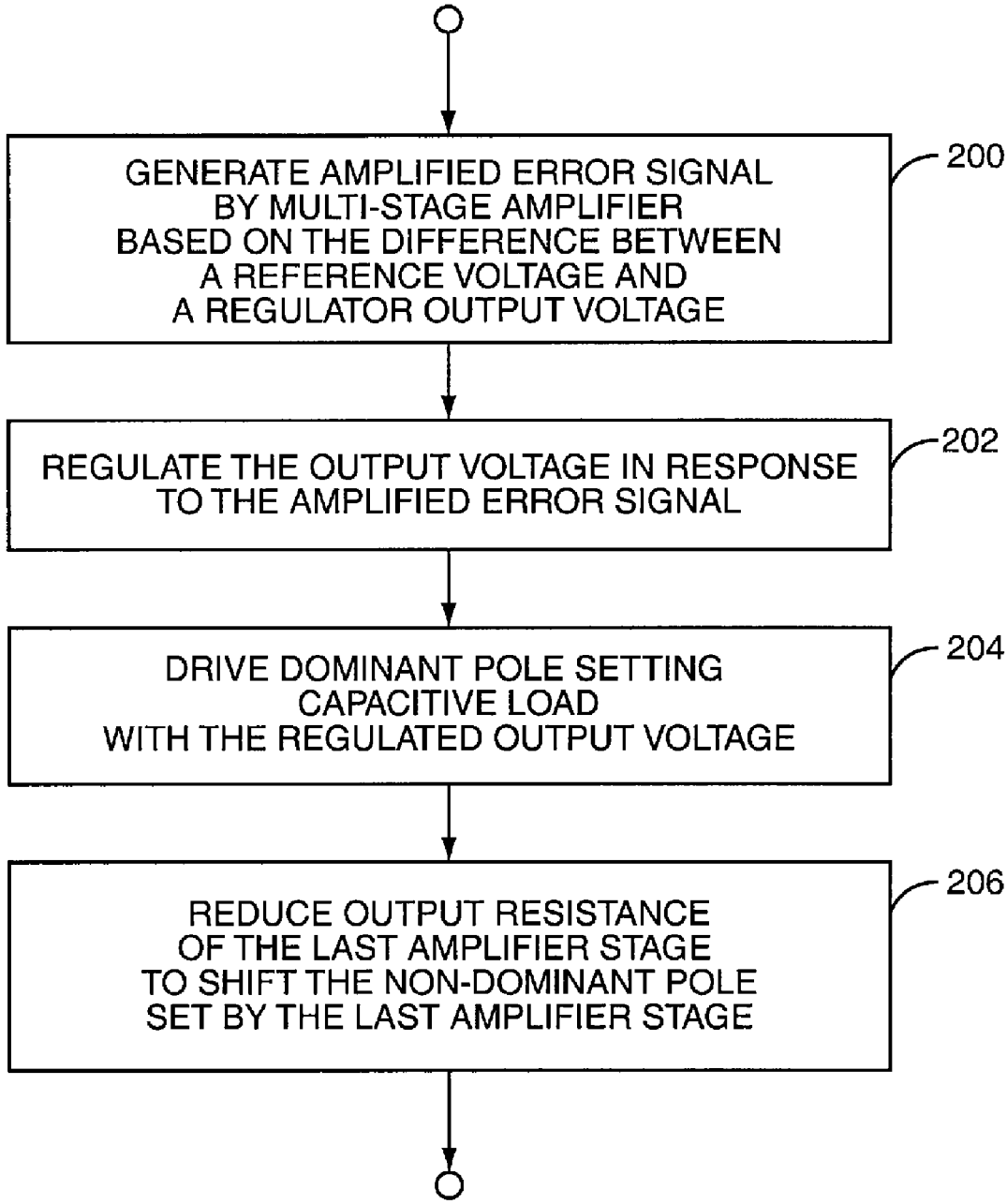
FIG. 2 is a logic flow diagram of an embodiment of program logic for reducing the transient response time of a multi-stage voltage regulator having a common-source output stage.

The common-source output stage 106 regulates the output voltage ($V_{REG}$) in response to the signal applied by the last amplifier stage 104, e.g., as illustrated by Step 202 of FIG. 2. The output stage 106 maintains the regulated voltage at or near the reference voltage despite changing load conditions. The regulated voltage provided by the output stage 106 drives the dominant pole setting capacitive load 108, e.g., as illustrated by Step 204 of FIG. 2.

The feedback path 110, which includes a feedback component 116 such as one or more resistors, pass gates or the like, senses the output voltage of the last amplifier stage 104 and generates a corresponding current ($I_{FBK}$) which is injected into the input node 114 of the last amplifier stage 104. As such, the feedback path 110 provides voltage-sensing, current return closed-loop feedback that causes the last amplifier stage 104 to act like a voltage source having low impedance. Particularly, the feedback component 116 attempts to maintain a constant voltage level, thus decreasing the output resistance of the last amplifier stage 104.

The non-dominant pole associated with the last amplifier stage 104 advantageously shifts when the output resistance of the last stage 104 is reduced, e.g., as illustrated by Step 206 of FIG. 2. The frequency shift incurred by the non-dominant pole is proportional to the amount by which the output resistance of the last amplifier stage 104 is decreased by the feedback path 110. Decreasing the output resistance of the last amplifier stage 104 via the feedback path 110 increases the $g_m$ of the last stage 104, thus improving the transient response of the voltage regulator 100 without increasing amplifier device size or bias current.

Figure 3:
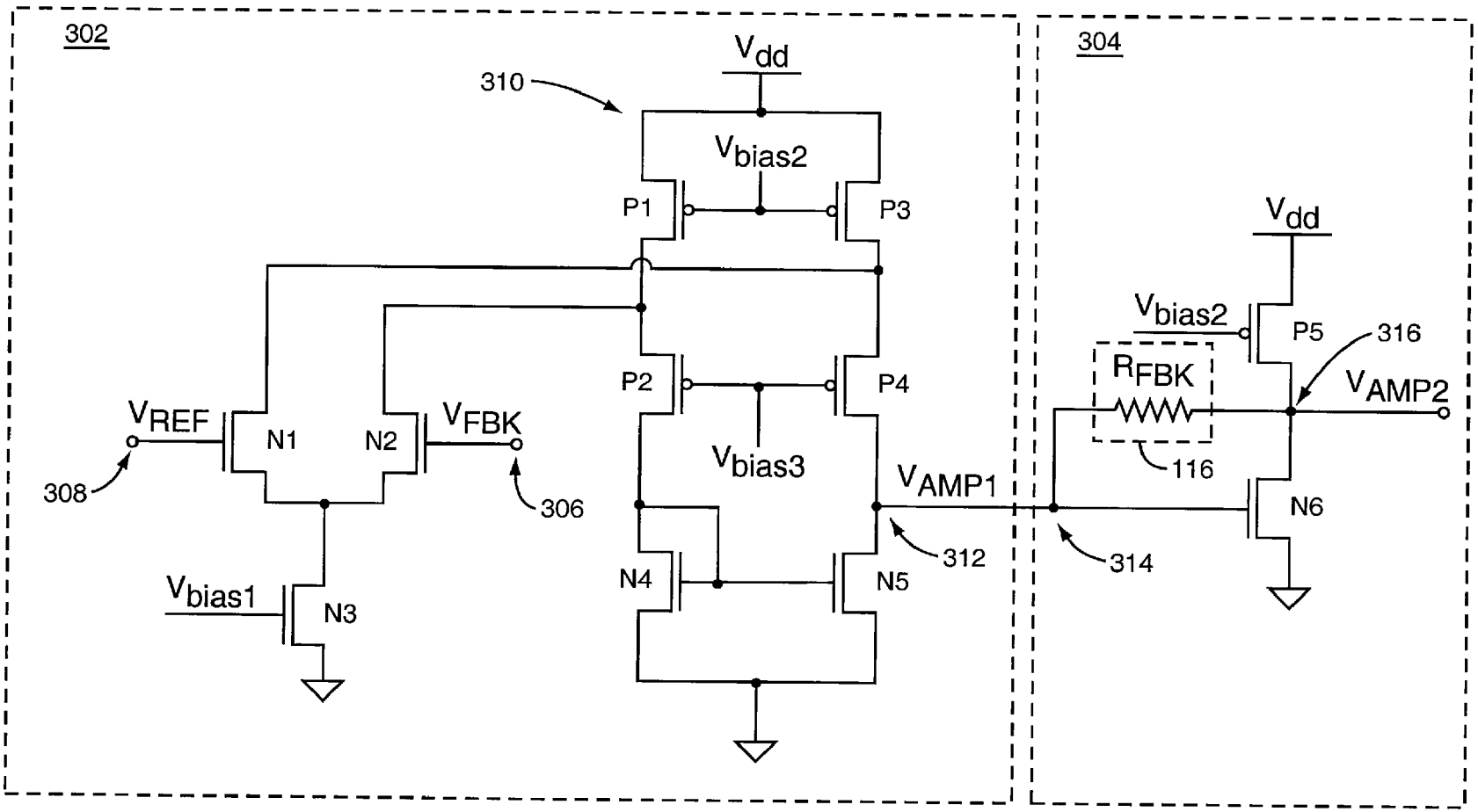
FIG. 3 is a block diagram of an embodiment of a multi-stage amplifier.

FIG. 3 illustrates an embodiment of a multi-stage amplifier 300 for use with the voltage regulator 100 of FIG. 1. According to this embodiment, the multi-stage amplifier 300 has two amplifier stages 302, 304 where the input amplifier stage 302 has a folded cascode topology. However, any number and type of amplifier stages may be used. In some embodiments, individual operational amplifiers may be coupled together to provide desired gain. In other embodiments, a plurality of amplifier stages may be provided as an integrated amplifier circuit. The topology of the amplifier stages 302, 304 depends on the device technology employed and application environment. Additional amplifier stages (not shown) may be used to accommodate high gain applications.

The regulated voltage output by the regulator 100 is fed back to one input node 306 of the input amplifier stage 302 as a feedback signal ($V_{FBK}$) while a reference voltage signal ($V_{REF}$) is applied to a second input node 308 of the input stage 302. Nfet devices N1 and N2 generate a quasi differential error signal representing the difference between $V_{REF}$ and $V_{FBK}$. A third nfet device N3 sets the bias current for nfet devices N1 and N2 based on a bias voltage input ($V_{bias1}$). A gain portion 310 of the input stage 302 amplifies the difference between $V_{REF}$ and $V_{FBK}$. The gain portion 310 comprises pfet devices P1 and P2 arranged in a cascode manner with complimentary pfet devices P3 and P4. A second bias voltage input ($V_{bias2}$) controls operation of complimentary pfet devices P1 and P3 while a third bias voltage input ($V_{bias3}$) controls operation of complimentary pfet devices P2 and P4. Nfet devices N4 and N5 set the current for the gain portion of the input stage 302.

The gain portion 310 of the input stage 302 drives an output node 312 of the input amplifier stage 302 to an amplified voltage level ($V_{AMP1}$) corresponding to the difference between $V_{REF}$ and $V_{FBK}$. The output of the input amplifier stage 302 is applied to an input node 314 of the last amplifier stage 304. The last amplifier stage 304 comprises pfet device P5 and nfet device N6. Pfet device P5 is biased by the second bias voltage input ($V_{bias2}$) and controls current flow in the last stage 304. Nfet device N6 is driven by the output of the input amplifier stage 302. Nfet device N6 and pfet device P5 provide additional gain and sufficient $g_m$ for driving the input capacitance of the common-source output stage 106. Nfet device N6 and pfet device P5 also isolate the common-source output stage 106 from the input amplifier stage 302. According to this embodiment, the last amplifier stage 304 provides negative gain. Regardless, the output resistance of the last amplifier stage 304 sets the non-dominant pole associated with the last stage 304 which in turns determines the amplifier bandwidth and transient response of the voltage regulator 100.

Without the feedback component 116 coupling the output node 316 of the last amplifier stage 304 to its input node 314, the open loop output resistance of the last amplifier stage 304 as seen by the regulator output stage 106 is given by:

$$R_{OUT_OPEN_LOOP}=R_{OUT_P5}\|R_{OUT_N6} \tag{1}$$

where $R_{OUT_P5}$ is the output resistance of pfet P5 and $R_{OUT_N6}$ is the output resistance of nfet N6. However, when the feedback component 116 is included, the closed loop output resistance of the last amplifier stage 304 decreases as given by:

$$\begin{aligned} R_{OUT_CLOSED_LOOP} &= \frac{R_{OUT_OPEN_LOOP}}{(1+A\beta)} \\ &= \frac{R_{OUT_OPEN_LOOP}}{[1+(gm_{N6}*R_{OUT_OPEN_LOOP})} \\ &= \frac{\left[R_{OUT_OPEN_LOOP}*\left(\frac{1}{gm_{N6}}\right)\right]}{\left[R_{OUT_OPEN_LOOP}+\left(\frac{1}{gm_{N6}}\right)\right]} \\ &= R_{OUT_OPEN_LOOP}\|\left(\frac{1}{gm_{N6}}\right) \end{aligned} \tag{2}$$

where $A\beta$ is the loop gain of the last amplifier stage 304 and $gm_{N6}$ is the transconductance of nfet N6. As such, the output resistance of the last amplifier stage 304 is reduced proportionally by the $g_m$ of nfet N6 when the feedback component 116 is coupled between the input and output nodes 314, 316 of the last amplifier stage 304. The feedback component 116 comprises a feedback resistor $R_{FBK}$ according to this embodiment. However, other types of feedback components such as one or more pass gates may be used to reduce the output resistance of the last amplifier stage 304.

Figure 4:
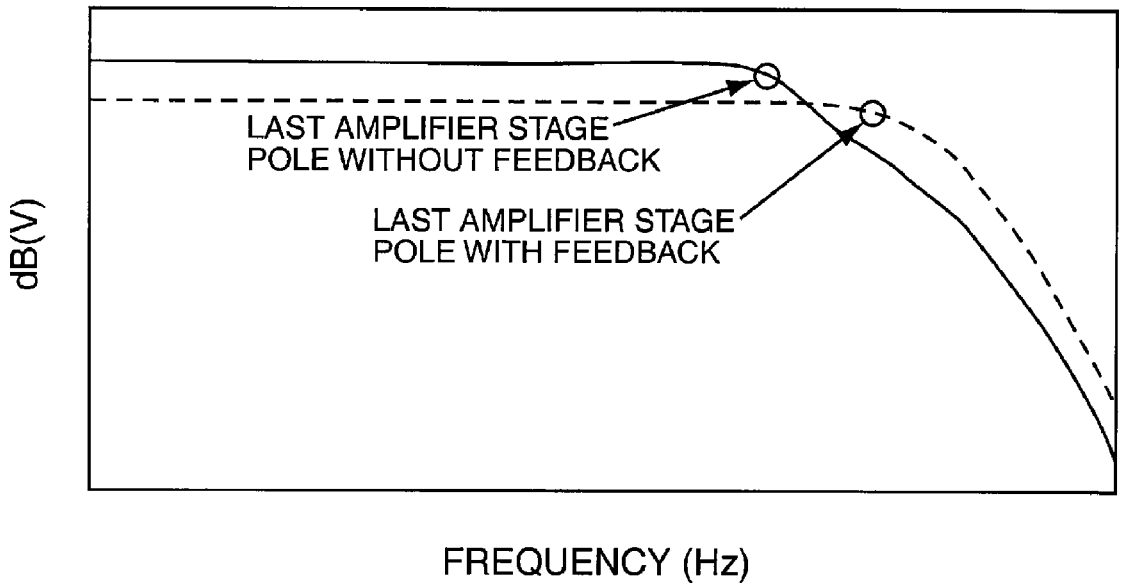
FIG. 4 is a plot diagram illustrating the frequency response of the multi-stage amplifier of FIG. 3.

FIG. 4 illustrates a plot diagram showing exemplary non-dominant pole shifting that results from coupling the input and output nodes 314, 316 of the last amplifier stage 304. The non-dominant pole associated with the last amplifier stage 304 experiences approximately a 6.7 times shift in 3 db frequency when the feedback path 110 is included in the voltage regulator 100 as described herein. The 3 db frequency point of the dominant pole (not shown) set by the high capacitive load 108 remains essentially unaffected when the feedback path 110 is included. Accordingly, the transient response time of the voltage regulator 100 is improved without adversely affecting regulator stability.

However, the overall gain of the multi-stage amplifier 300 is reduced when the feedback path 110 is used. Without the feedback path 110, the multi-stage amplifier gain is $A_o$, where each stage 302, 304 of the amplifier 300 contributes to $A_o$. The multi-stage amplifier gain decreases to $$\frac{A_o}{1+A\beta}$$

when the feedback path 110 is included in the voltage regulator 100, where Aβ is the loop gain of the last amplifier stage 304. However, the 3 db frequency of the multi-stage amplifier 300 improves from $\omega_o$ without the feedback path 110 to $\omega_o(1+A\beta)$ with the feedback path 110.

Moreover, the gain of the input amplifier stage 302 (and/or intermediary amplifier stages if included) may be selected to compensate for the overall amplifier gain reduction caused by the feedback path 100. This way, the gain of one or more amplifier stages 302 preceding the last amplifier stage 304 may be increased to compensate for gain reduction caused by the feedback component 116. The voltage regulator 100 may be included in any type of integrated circuit such as processors, memory devices, custom logic, or any other device requiring a regulated voltage.

With the above range of variations and applications in mind, it should be understood that the present invention is not limited by the foregoing description, nor is it limited by the accompanying drawings. Instead, the present invention is limited only by the following claims and their legal equivalents.

What is claimed is:

1. A voltage regulator, comprising:

a common-source output stage configured to drive a capacitive load with a regulated voltage responsive to a signal applied to the common-source output stage, the capacitive load setting the dominant pole of the voltage regulator;

a first amplifier stage configured to amplify the difference between the regulated voltage and a reference voltage;

a second amplifier stage configured to drive the common-source output stage with a signal corresponding to the difference between the regulated voltage and the reference voltage; and a feedback path configured to couple an output node of the second amplifier stage to an input node of the second amplifier stage for reducing the output resistance of the second amplifier stage to shift a non-dominant pole of the voltage regulator set by the second amplifier stage.

2. The voltage regulator of claim 1, wherein the feedback path comprises one or more resistors coupling the output node of the second amplifier stage to the input node of the second amplifier stage.

3. The voltage regulator of claim 1, further comprising one or more additional amplifier stages coupled between the first and second amplifier stages.

4. The voltage regulator of claim 1, wherein the feedback path is configured to sense the voltage level at the output node of the second amplifier stage and inject a current corresponding to the sensed voltage level into the input node of the second amplifier stage.

5. The voltage regulator of claim 1, wherein the gain of the first amplifier stage is selected to compensate for reduction in the gain of the second amplifier stage caused by the feedback path.

6. The voltage regulator of claim 1, wherein the second amplifier stage is configured to provide negative gain.

7. A voltage regulator, comprising:

a common-source output stage configured to drive a capacitive load with a regulated voltage responsive to a signal applied to the common-source output stage, the capacitive load setting the dominant pole of the voltage regulator;

a first amplifier stage configured to amplify the difference between the regulated voltage and a reference voltage;

a second amplifier stage configured to drive the common-source output stage with a signal corresponding to the difference between the regulated voltage and the reference voltage; and means for reducing the output resistance of the second amplifier stage to shift a non-dominant pole of the voltage regulator set by the second amplifier stage.

8. The voltage regulator of claim 7, further comprising one or more additional amplifier stages coupled between the first and second amplifier stages.

9. The voltage regulator of claim 7, wherein the means for reducing the output resistance of the second amplifier stage comprises a feedback path coupling an output node of the second amplifier stage to an input node of the second amplifier stage.

10. The voltage regulator of claim 9, wherein the feedback path is configured to sense the voltage level at the output node of the second amplifier stage and inject a current corresponding to the sensed voltage level into the input node of the second amplifier stage.

11. The voltage regulator of claim 9, wherein the feedback path comprises one or more resistors coupling the output node of the second amplifier stage to the input node of the second amplifier stage.

12. A method of operating a voltage regulator having multiple amplifier stages and a common-source output stage, the method comprising:

applying an amplified signal provided by the amplifier stages to the common-source output stage;

driving a capacitive load with a regulated voltage provided by the common-source output stage responsive to the amplified signal, the capacitive load setting the dominant pole of the voltage regulator; and increasing the transconductance of the amplifier stage coupled to the common-source output stage to shift a non-dominant pole of the voltage regulator set by that amplifier stage.

13. The method of claim 12, wherein increasing the transconductance of the amplifier stage coupled to the common-source output stage comprises reducing the output resistance of that amplifier stage.

14. The method of claim 13, wherein reducing the output resistance of the amplifier stage coupled to the common-source output stage comprises coupling an output node of that amplifier stage to an input node of that amplifier stage.

15. The method of claim 14, wherein reducing the output resistance of the amplifier stage coupled to the common-source output stage comprises:

sensing the voltage level at the output node of that amplifier stage; and injecting a current corresponding to the sensed voltage level into the input node of that amplifier stage.

16. A method of operating a voltage regulator having first and second amplifier stages and a common-source output stage, the method comprising:

driving a capacitive load with a regulated voltage output by the common-source output stage responsive to a signal applied to the common-source output stage, the capacitive load setting the dominant pole of the voltage regulator;

amplifying the difference between the regulated voltage and a reference voltage applied to the first amplifier stage;

driving the common-source output stage with a signal output by the second amplifier stage corresponding to the difference between the regulated voltage and the reference voltage; and reducing the output resistance of the second amplifier stage to shift a non-dominant pole of the voltage regulator set by the second amplifier stage.

17. The method of claim 16, further comprising selecting the gain of the first amplifier stage to compensate for reduction in the gain of the second amplifier stage caused by the feedback path.

18. The method of claim 16, wherein reducing the output resistance of the second amplifier stage comprises coupling an output node of the second amplifier stage to an input node of the second amplifier stage.

19. The method of claim 18, wherein reducing the output resistance of the second amplifier stage comprises:

sensing the voltage level at the output node of the second amplifier stage; and injecting a current corresponding to the sensed voltage level into the input node of the second amplifier stage.

* * * * *